United States Patent [19]

Trowbridge

[11] Patent Number: 4,836,182

[45] Date of Patent: Jun. 6, 1989

[54] GAS BURNING HEATING DEVICE

[76] Inventor: Daniel W. Trowbridge, 12212 Cliffwood Ave., Garden Grove, Calif. 92640

[21] Appl. No.: 203,878

[22] Filed: Jun. 8, 1988

[51] Int. Cl.[4] ..... F24D 15/02

[52] U.S. Cl. ..... 126/109; 126/72; 126/114; 126/118; 126/110 R; 126/116 A; 126/116 R; 126/522; 126/523; 126/524

[58] Field of Search ..... 126/521, 522, 523, 524, 126/70, 71, 72, 106, 108, 114, 118, 116, 117, 110 R, 110 A, 110 AA, 110 B, 116 A; 237/50, 52, 53

[56] References Cited

U.S. PATENT DOCUMENTS

| | | | |
|---|---|---|---|
| 557,551 | 4/1896 | Capewell | 126/116 R |
| 1,527,732 | 2/1925 | Gross | 126/70 |
| 3,601,115 | 8/1971 | Weatherston . | |
| 3,712,286 | 1/1973 | Nelson . | |
| 4,112,915 | 9/1978 | Slavik | 126/522 |
| 4,478,206 | 10/1984 | Ahn . | |
| 4,558,689 | 12/1985 | McCann . | |
| 4,579,102 | 1/1986 | Sukup . | |

*Primary Examiner*—Samuel Scott
*Assistant Examiner*—Carl D. Price
*Attorney, Agent, or Firm*—Jerry T. Kearns

[57] ABSTRACT

A forced air gas fired heating device may be utilized as a stove insert for a conventional open fireplace or in an alternative embodiment may be formed with a double walled construction for use as a free standing unit. In both embodiments a gas burner adjacent a bottom portion of the housing heats an air space within the housing. A room air inlet conduit traverses back and forth across the heated air space and communicates with an air distribution chamber in an upper portion of the housing. A plurality of room air outlet conduits extend outwardly from the distribution chamber through a front wall of the housing. A heat exchanger is suspended from each of the room air outlet conduits and includes a hollow body portion in fluid communication with the associated air outlet conduit. Each of the heat exchangers has an enclosed longitudinally extending corrugated heat conductive metal plate and terminates in a bottom heat conducted metal plate deposed adjacent the gas burner. Room air is inducted through an air intake opening in the side of the housing, through an air filter and through the air inlet conduit to the air distribution chamber. Heated air is then exhausted through the air outlet conduits through the front of the housing. Conventional thermostatic controls may be utilized and a pressurized gas supply tank may be provided in the housing interior. This enables the device to be utilized in campers and in remote cabins.

5 Claims, 5 Drawing Sheets

GAS BURNING HEATING DEVICE

BACKGROUND OF THE INVENTION

1. Field of the Invention

The present invention relates to heating devices, and more particularly pertains to a new and improved gas fired forced air heating device. Wood burning stoves and fireplaces create a relatively large amount of air pollution as compared with efficient clean burning gas heating devices. Many areas now recognize the acute pollution problems created by a large number of wood burning heating devices. For example, Denver, Colo. has voluntary non-burn days and is currently considering a law limiting the burning of wood on high pollution days. Aspen, Colo. currently has a ban on the construction of new fireplaces. In addition to the pollution problems created by such wood burning heating devices, these devices necessitate the collecting, cutting, splitting, drying and storing of firewood. Alternatively, firewood may be purchased at increasingly high prices. In order to overcome these problems, the present invention provides an efficient gas burning heating device which may be utilized as an insert in a conventional fireplace or which alternatively may be constructed as a free standing unit.

2. Description of the Prior Art

Various types of heating devices are known in the prior art. A typical example of such a heating device is to be found in U.S. Pat. No. 3,601,115, which issued to R. Weatherston on Aug. 24, 1971. This patent discloses a high-flame facing area heat exchanger in which the air passage ways pass both around and through the combustion chamber in a repetitive crisscross pattern. U.S. Pat. No. 3,712,286, which issued to C. Nelson on Jan. 23, 1973, discloses a heat exchanger having an elongated combustion chamber with a burner opening in one end and a pair of ducts leading from the other end to a pair of separate headers. Two groups of tubes extend from the two headers along the combustion chamber for connection with a common header and a third group of tubes extend from the common header to a combustion gas discharge header positioned between the first two headers. U.S. Pat. No. 4,478,206, which issued to H. Ahn on Oct. 23, 1984, discloses a secondary heat exchanger installed above the preliminary heat exchanger in a down draft type gas burning furnace. U.S. Pat. No. 4,558,689, which issued to A. McCann on Dec. 17, 1985, discloses a secondary heat exchanger positioned within a cold air return plenum of a forced air gas or oil fired furnace to preheat cold air drawn into the furnace through the cold air plenum. U.S. Pat. 4,579,102, which issued to E. Sukup on Apr. 1, 1986, discloses a hot air heat exchanger furnace that uses crop residue as a fuel source and is utilized for producing the heat required for drying of grains and other crop products. The furnace includes a combustion chamber, an upper manifold, a lower manifold, a plenum and a number of exhaust tubes.

While the above mentioned devices are suited for their intended usage, none of these devices provide a gas fired forced air heating unit suitable for use as an insert in a conventional fireplace. Additionally, none of the aforesaid devices disclose a heating unit which utilizes a plurality of room air outlet conduits each in fluid communication with a hollow enclosed heat exchanger having an elongated corrugated heat conducting interior metal plate and provided with a bottom heat conductive metal plate disposed adjacent a gas burner. Inasmuch as the art is relatively crowded with respect to these various types of heating devices, it can be appreciated that there is a continuing need for and interest in improvements to such heating devices, and in this respect, the present invention addresses this need and interest.

SUMMARY OF THE INVENTION

In view of the foregoing disadvantages inherent in the known types of heating devices now present in the prior art, the present invention provides an improved gas burning heating device. As such, the general purpose of the present invention, which will be described subsequently in greater detail, is to provide a new and improved gas burning heating device which has all the advantages of the prior art heating devices and none of the disadvantages.

To attain this, representative embodiments of the concepts of the present invention are illustrated in the drawings and make use of a stove insert for a conventional open fireplace or in an alternative embodiment, the device may be formed with a double walled construction for use as a free standing unit. In both embodiments a gas burner adjacent a bottom portion of the housing heats an air space within the housing. A room air inlet conduit traverses back and forth across the heated air space and communicates with an air distribution chamber in an upper portion of the housing. A plurality of room air outlet conduits extend outwardly from the distribution chamber through a front wall of the housing. A heat exchanger is suspended from each of the room air outlet conduits and includes a hollow body portion in fluid communication with one of the air outlet conduits. Each of the heat exchangers has an enclosed longitudinally extending corrugated heat conductive metal plate and terminates in a bottom heat conducting metal plate disposed adjacent the gas burner. Room air is inducted through an air intake opening in the side of the housing, through an air filter and through the air inlet conduit to the air distribution chamber. Heated air is then exhausted through the air outlet conduits through the front of the housing. Conventional thermostatic controls may be utilized and in a second embodiment a pressurized gas supply tank may be provided in the housing interior. This enables the device to be utilized in campers and in remote cabins.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gas burning heating device which has all the advantages of the prior art heating devices and none of the disadvantages.

It is another object of the present invention to provide a new and improved gas burning heating device which may be easily and efficiently manufactured and marketed.

It is a further object of the present invention to provide a new and improved gas burning heating device which is of a durable and reliable construction.

An even further object of the present invention is to provide a new and improved gas burning heating device which is susceptible of a low cost of manufacture with regard to both materials and labor, and which accordingly is then susceptible of low prices of sale to the consuming public, thereby making such heating devices economically available to the buying public.

Still yet another object of the present invention is to provide a new and improved gas burning heating device which provides in the apparatuses and methods of the prior art some of the advantages thereof, while simultaneously overcoming some of the disadvantages normally associated therewith.

Still another object of the present invention is to provide a new and improved gas burning heating device which may be utilized as an insert in a conventional fireplace.

Yet another object of the present invention is to provide a new and improved gas burning heating device which may be formed with a double walled construction for use as a free standing portable unit in recreational vehicles and remote cabins.

Even still another object of the present invention is to provide a new and improved gas burning heating device with an improved heat exchanger construction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
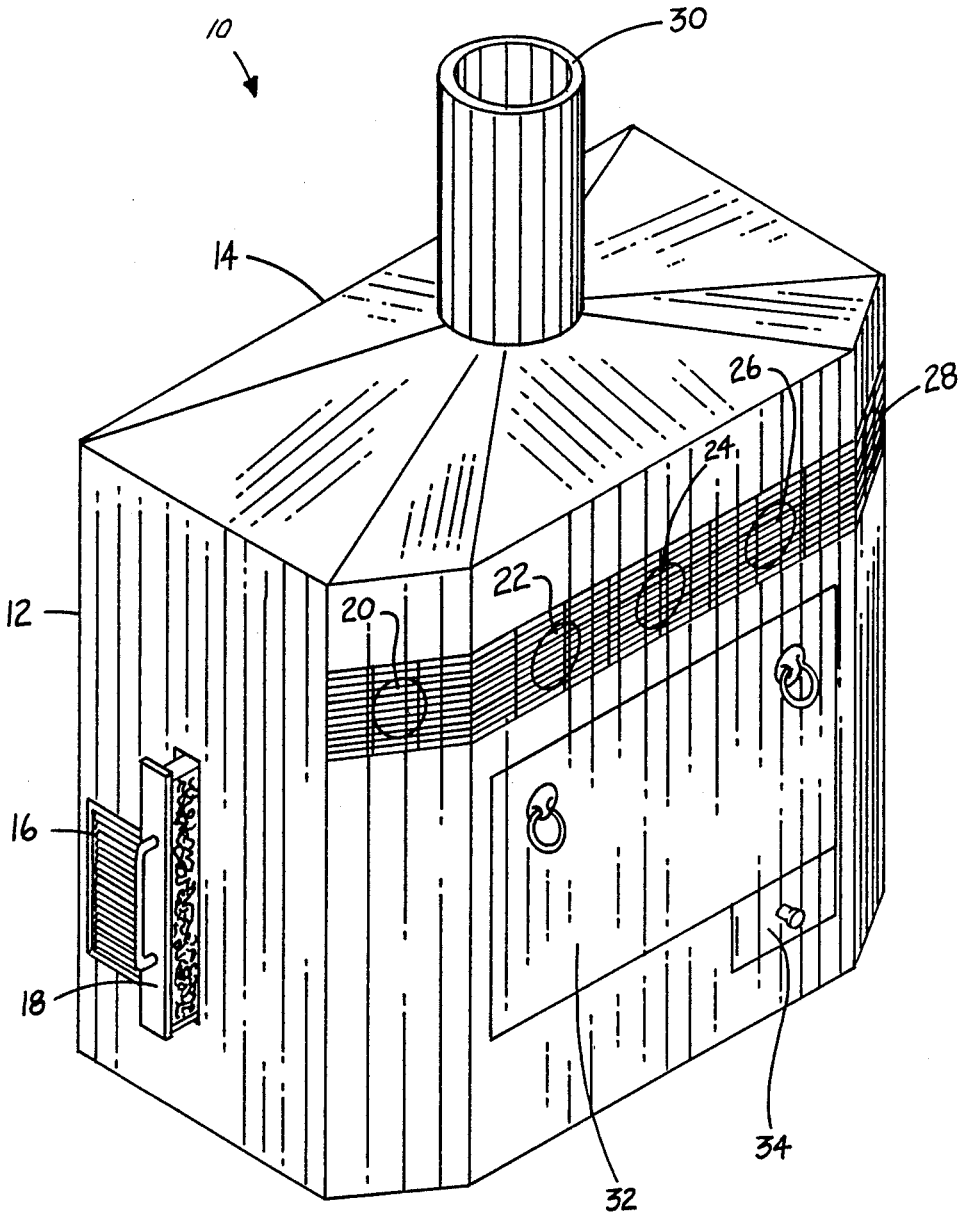
FIG. 1 is a perspective view of the gas burning heating device according to a first embodiment of the present invention.

With reference now to the drawings, and in particular to FIG. 1 thereof, a new and improved gas burning heating device embodying the principles and concepts of the present invention and generally designated by the reference numeral 10 will be described.

More specifically, it will be noted that the first embodiment 10 of the invention includes a housing 12 having a hexagonal transverse cross sectional shape. The housing 12 has a roof portion 14 formed by a plurality of inclined facets for directing exhaust gases to an exhaust outlet flue 30 which extends from the roof portion 14 of the housing 12. A room air inlet 16 is formed through a side wall of the housing 12. Room air is inducted through the inlet 16 and passes through a removable filter 18. Heated room air is returned to the room through a plurality of outlets 20, 22, 24, 26 and 28 which are formed through a front wall of the housing 12. A hinged access door 32 is provided on the front wall of the housing 12 and a secondary door 34 is provided for access to internal controls. The heating device 10 is of the gas fired forced air type and may be provided with conventional timed thermostatic controls. The housing 12 is dimensioned to be received within the interior of a conventional fireplace.

Figure 2:
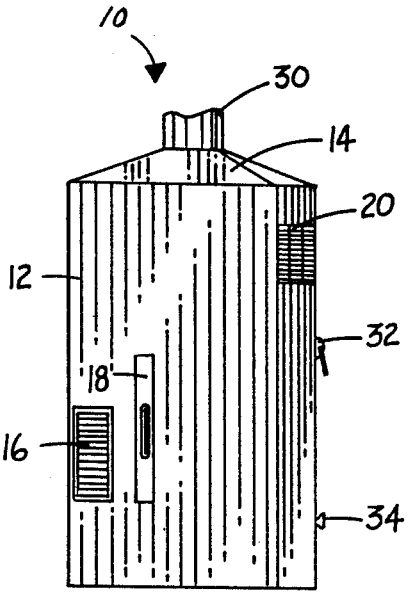
FIG. 2 is a side view of the heating device according to the first embodiment of the present invention.

FIG. 2 provides a side view of the heating device 10.

Figure 3:
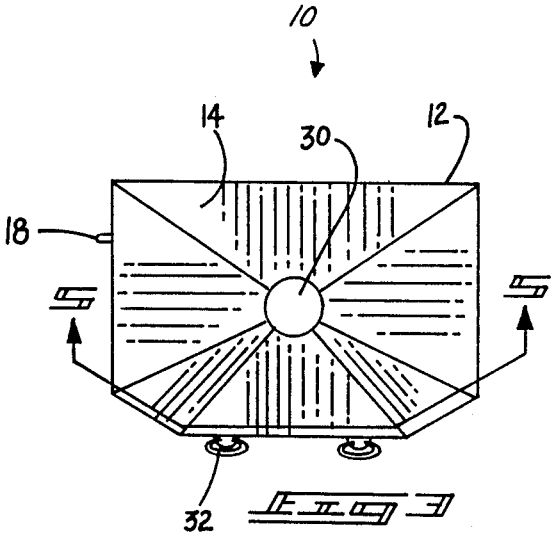
FIG. 3 is a top view of the heating device according to the first embodiment of the present invention.

FIG. 3 provides a top view of the heating device 10.

Figure 4:
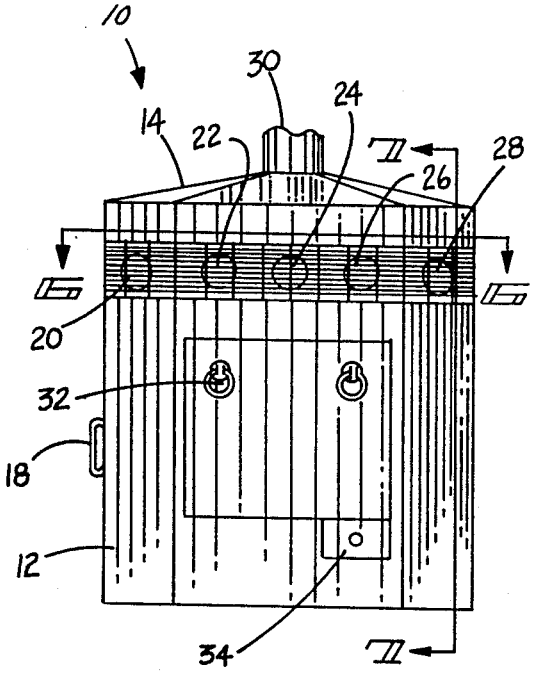
FIG. 4 is a front view of the heating device according to the first embodiment of the present invention.

FIG. 4 illustrates a front view of the heating device 10.

Figure 5:
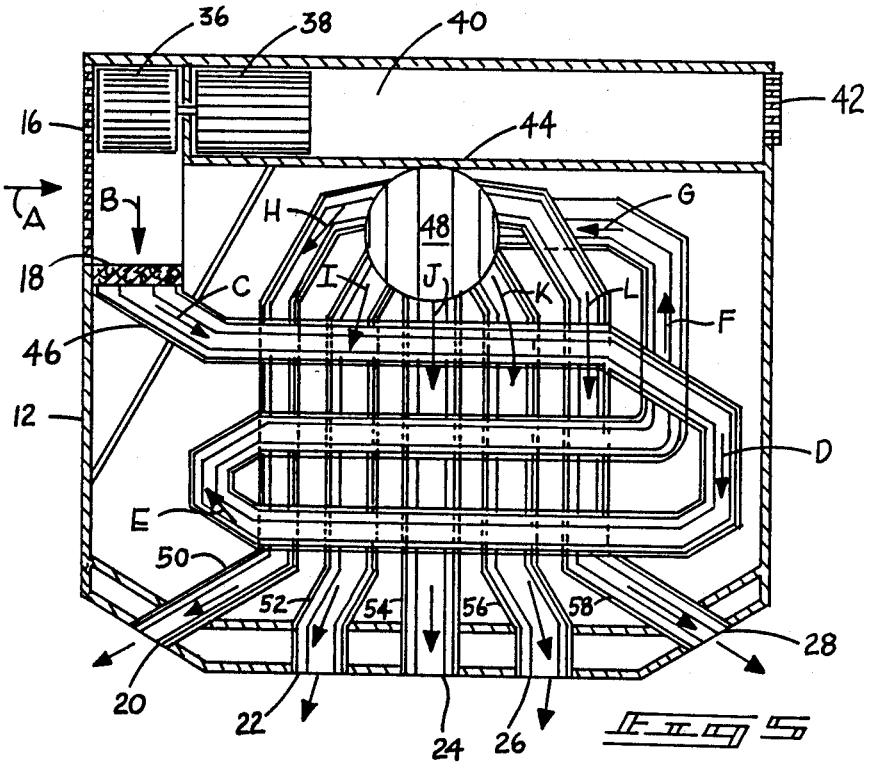
FIG. 5 is a transverse cross sectional view, taken along line 5—5 of FIG. 3.

With reference now to FIG. 5, the internal construction of the heating device 10 according to the first embodiment of the present invention will now be described. A squirrel cage type impeller 36 is driven by a conventional blower motor 38 located within a hollow chamber 40 adjacent a back wall of the housing 12. An air inlet 42 provides ventilation for cooling the motor 38. The impeller 36 draws air through the room air inlet 16 through the filter 18 and into a room air inlet conduit 46. The room air inlet conduit 46 extends transversely back and forth through a heated air space within the interior of the housing 12. The first end of the room air inlet conduit 46 terminates at the air filter 18 and the second end of the conduit 46 terminates in a hollow room air distribution chamber 48. A plurality of room air outlet conduits 50, 52, 54, 56 and 58 extend from the air distribution chamber 48 to the room air outlets 20, 22, 24, 26 and 28 formed through the front wall of the housing 12. Thus, the room air passes into the housing 12 through the air intake opening 16 as indicated by arrow A, through the air filter 18 as indicated by arrow B, and is then inducted through the filter 18 into the room air inlet conduit 46 as indicated by arrow C, and flows through the conduit 46 back and forth across the heated air space as indicated by arrows D, E and F, and into the hollow air distribution chamber 48 as indicated by arrow G. The distribution chamber 48 acts as an exhaust manifold which divides the now heated room air into the room air outlet conduits 50, 52, 54, 56 and 58 as indicated by arrows H, I, J, K and L.

Figure 6:
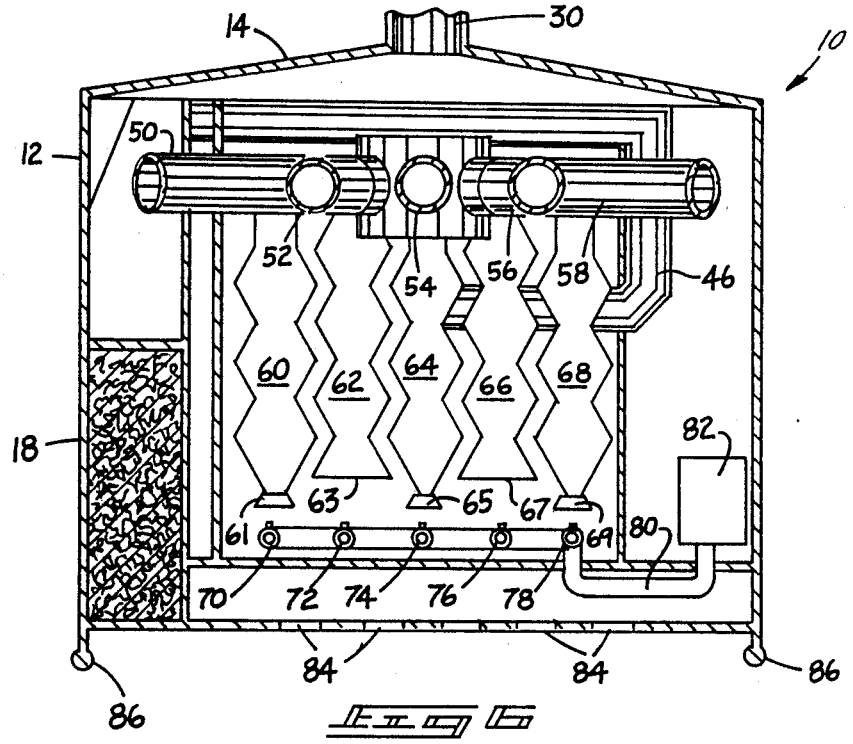
FIG. 6 is a longitudinal cross sectional view taken along line 6—6 of FIG. 4.

As shown in the cross sectional view of FIG. 6, a heat exchanger 60, 62, 64, 66 and 68 is suspended from each of the air outlet conduits 50, 52, 54, 56 and 58. Each of the heat exchangers 60, 62, 64, 66 and 68 is formed as a closed hollow body portion which has a cylindrical upper end which forms a portion of one of the conduits 50, 52, 54, 56 and 58. Thus, the hollow interior of each of the heat exchangers 60, 62, 64, 66 and 68 is in fluid communication with one of the air outlet conduits 50, 52, 54, 56 and 58. Additionally, this construction serves to suspend the heat exchangers from the air outlet conduits within the heated air space in the interior of the housing 12. As illustrated, each of the heat exchangers 60, 62, 64, 66 and 68 has two opposed side walls each formed by a series of intersecting inclined metal plates arranged in a series of alternating V-shaped ridges. This provides an increased surface area to each of the heat exchangers as compared to a construction utilizing planar side faces. Each of the heat exchangers 60, 62, 64, 66 and 68 terminate in a respective flat heat conductive metal plate 61, 63, 65, 67 and 69 disposed adjacent one of the gas burners 70, 72, 74, 76 and 78 situated in a bottom portion of the housing 12. Gas is supplied to the burners through a supply line 80 from a conventional regulating valve 82 which is connected to a conventional natural gas supply line. Heated air and combustion product gases travel upwardly between the heat exchangers 60, 62, 64, 66 and 68 and between the air outlet conduits 50, 52, 54, 56 and 58 and are exhausted through the flue 30. A plurality of combustion air inlets 84 are formed through a floor portion of the housing 12 to provide combustion air to the gas burners 70, 72, 74, 76 and 78. The location of the combustion air inlets 84 is selected to induct cold air which has settled to the lower levels of the room for combustion purposes.

Figure 7:
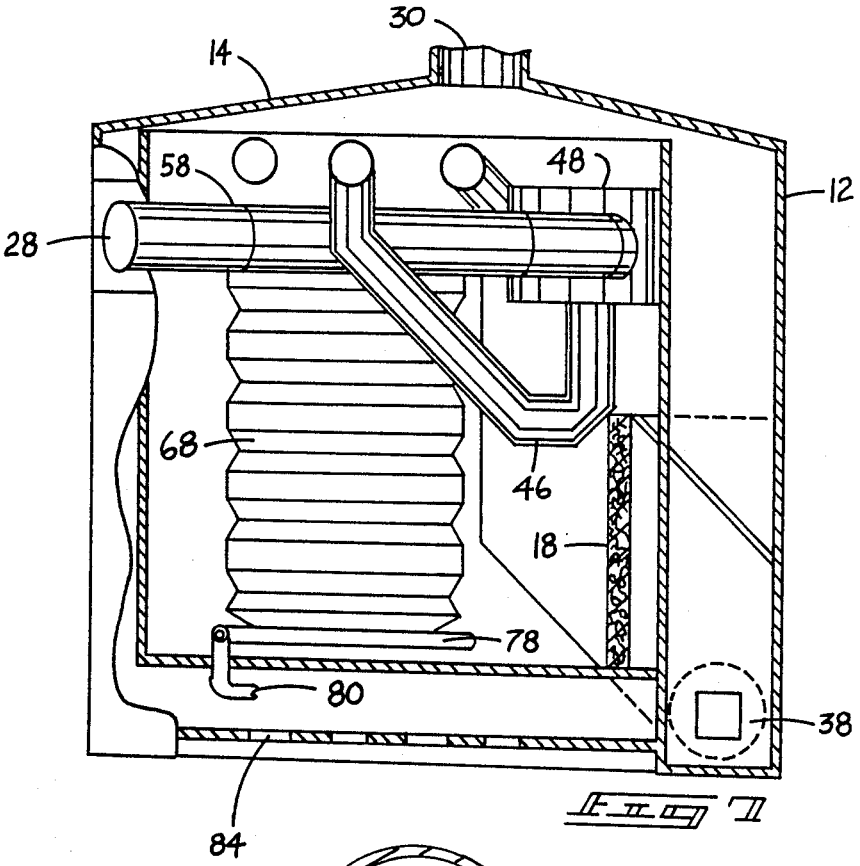
FIG. 7 is a longitudinal cross sectional right side view taken along line 7—7 of FIG. 4.

FIG. 7 illustrates a longitudinal cross sectional right side view of the housing 12. This provides a side view of one of the heat exchangers 68 which is suspended from the air outlet conduit 58. The alternating V-shaped ridged construction of the side face of the heat exchanger 68 may now be readily understood.

Figure 8:
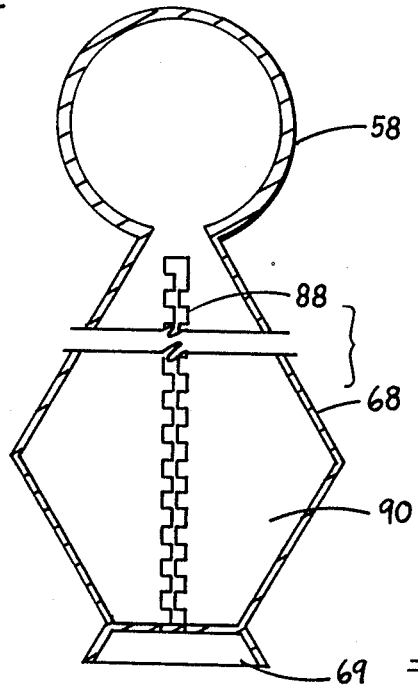
FIG. 8 is a longitudinal cross sectional view illustrating the construction of the heat exchanger utilized in the first and second embodiments of the present invention.

FIG. 8 provides a transverse cross sectional view which illustrates the construction of one of the heat exchange units 68. The upper portion of the heat exchange unit 68 is cylindrical in shape and forms a segment of the air outlet conduit 58. Thus, the hollow interior 90 of the heat exchanger 68 is in fluid communication with the heated room air outlet conduit 58. A longitudinally extending corrugated heat conductive metal plate 88 extends along the length of, and is centrally disposed within, the hollow interior 90 of the heat exchanger 68. The bottom end of the metal plate 88 is mounted on the bottom flat metal heat conductive floor plate 69. The heat conductive floor plate 69 is disposed adjacent one of the gas burners within the housing 12. Thus, heat is conducted from the floor plate 69 along the corrugated metal plate 88. The corrugated metal plate 88 serves as a radiator which heats the air within the hollow interior 90. Thus, room air is heated by convection and radiation within the heat exchanger 68 and is exhausted through the room air outlet conduit 58.

Figure 9:
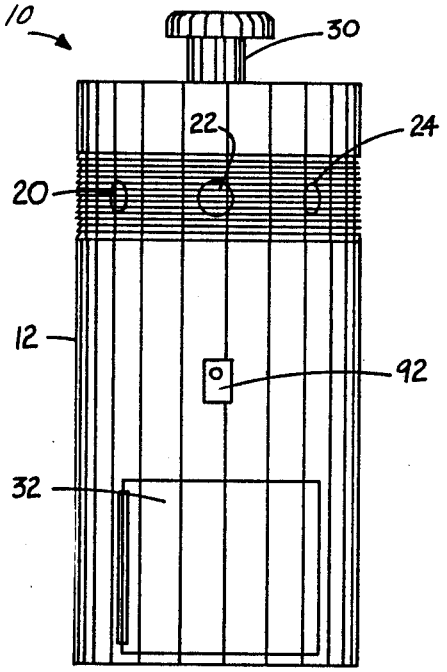
FIG. 9 is a front view illustrating a free standing heating device according to a second embodiment of the present invention.

FIG. 9 illustrates a second embodiment 10′ of the present invention which is constructed with a cylindrical shaped housing 12′ and is adapted for use as a portable free standing unit. Similar parts have been referenced by the same numerals utilized to reference these parts in connection with the above description of the first embodiment 10 of the present invention. A conventional thermostatic control 92 is mounted on the exterior wall of the housing 12′.

Figure 10:
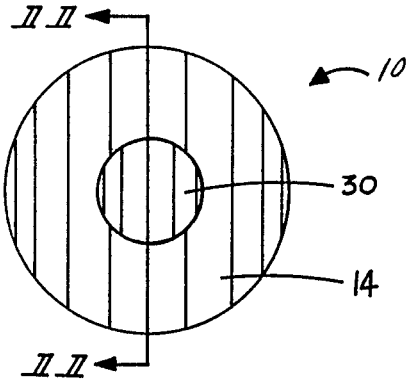
FIG. 10 is a top view of the heating device according to the second embodiment of the present invention.

FIG. 10 provides a top view of the second embodiment 10′ which illustrates the exhaust fluid 30′ which extends through the roof 14′.

Figure 11:
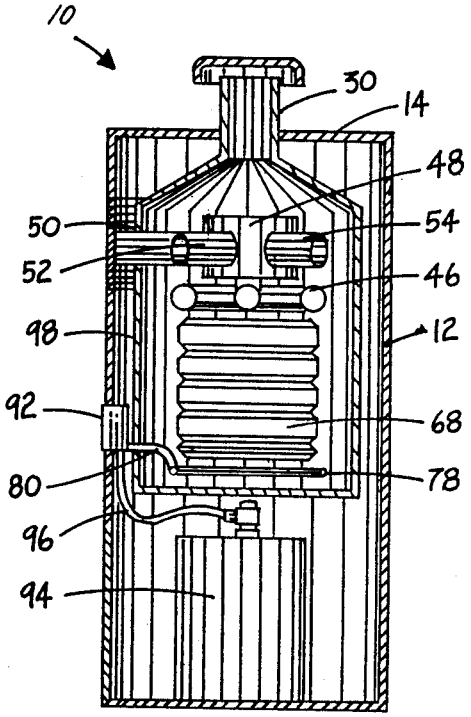
FIG. 11 is a longitudinal cross sectional view, taken along line 11—11 of FIG. 10.

FIG. 11 provides a longitudinal cross sectional view which illustrates the internal construction of the second embodiment 10′ of the present invention. The gas burner 78′, the heat exchangers of which one 68′ is illustrated, the air inlet conduit 46′, the air outlet conduits 50′, 52′ and 54′, and the air distribution chamber 48′ are all located within a secondary interior cylindrical housing 98′. This provides a double walled construction which enables the unit 10′ to be utilized as a free standing heating unit in recreational vehicles and remote cabins. The heat exchangers 68′, the air inlet conduit 46′ and the air outlet conduits 50′, 52′ and 54′ are similarly configured and constructed as described with reference to the first embodiment 10 of the present invention. For use in locations where a supply of natural gas is not available, a pressurized gas storage tank 94 is provided within the interior of the housing 12′, beneath the secondary housing 98. A gas supply line 96 supplies gas to the burner supply line 80′ via a conventional thermostatic control 92. The gas is then burned by the burner 78′ within the interior of the secondary housing 98. This provides a highly efficient, clean burning and easily transportable heating device for use in recreational vehicles and remote cabins.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gas burning heating device, comprising:

a housing;

a gas burner in a lower portion of said housing;

a heated air space within said housing and above said gas burner;

a roof at a top portion of said housing;

an exhaust flue in said roof;

a room air intake opening in said housing;

an air intake blower means adjacent to and in fluid flow communication with said room air intake opening to draw room air from exterior of said housing through said room air intake opening;

a room air inlet conduit within said housing having a first end connected in fluid flow communication to said air intake blower means;

an air filter disposed over said first end of said room air inlet conduit;

said room air inlet conduit extending back and forth across said heated air space within said housing;

a room air distribution chamber in an upper portion of said housing;

said room air inlet conduit having a second end connected to and in fluid flow communication with said room air distribution chamber;

a plurality of room air outlet conduits extending from and in fluid flow communication with said distribution chamber across said heated air space and through a front wall of said housing;

a heat exchanger suspended from each of said room air outlet conduits and in said heated air space;

each of said heat exchangers having a hollow body portion in fluid communication with one of said air outlet conduits, said hollow body portion having therein an enclosed longitudinally extending corrugated heat conductive metal plate, said hollow body portion having a bottom heat conductive metal plate disposed adjacent said gas burner and connected to said corrugated heat conductive metal plate; and a combustion air inlet formed in a bottom portion of said housing.

2. The gas burning heating device of claim 1, wherein each of said heat exchanger hollow body portions has opposed side faces formed by a series of intersecting inclined metal plates arranged in a series of alternating V-shaped ridges.

3. The gas burning heating device of claim 1, wherein said housing has a hexagonal transverse cross sectional shape dimensioned for insertion into a conventional open fireplace.

4. The gas burning heating device of claim 1, wherein said housing has a generally cylindrical shape and said gas burner, said heat exchanger, said heated air space, said room air inlet conduit, said room air outlet conduits and said room air distribution chamber are enclosed within a second interior housing in spaced relation within said cylindrical housing.

5. The gas burning heating device of claim 4, further comprising a pressurized gas supply tank in a lower portion of said cylindrical housing.

* * * * *